US006834628B2

(12) United States Patent
Duesmann

(10) Patent No.: US 6,834,628 B2
(45) Date of Patent: Dec. 28, 2004

(54) MECHANICAL VALVE PLAY COMPENSATION ELEMENT FOR A VALVE DRIVE ON A PISTON COMBUSTION ENGINE

(75) Inventor: Markus Duesmann, Stolberg (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 10/181,222

(22) PCT Filed: Oct. 22, 2001

(86) PCT No.: PCT/EP01/12157

§ 371 (c)(1),
(2), (4) Date: Oct. 2, 2002

(87) PCT Pub. No.: WO02/40833

PCT Pub. Date: May 23, 2002

(65) Prior Publication Data

US 2003/0089324 A1 May 15, 2003

(30) Foreign Application Priority Data

Nov. 14, 2000 (DE) ..... 100 45 423

(51) Int. Cl.[7] ..... F01L 1/14

(52) U.S. Cl. ..... 123/90.52; 123/90.39; 123/90.44; 123/90.48; 123/90.55

(58) Field of Search ..... 123/90.39, 90.4, 123/90.41, 90.42, 90.43, 90.44, 90.45, 90.46, 90.48, 90.49, 90.5, 90.52, 90.55, 90.57

(56) References Cited

U.S. PATENT DOCUMENTS

| | | | | |
|---|---|---|---|---|
| 1,445,118 A | | 2/1923 | Ware | |
| 1,757,721 A | | 5/1930 | Klemm | |
| 2,933,074 A | | 4/1960 | Moser | |
| 4,200,081 A | * | 4/1980 | Meyer et al. | 123/198 F |
| 4,387,675 A | * | 6/1983 | Hori et al. | 123/90.58 |
| 4,941,438 A | * | 7/1990 | Muto | 123/90.46 |
| 5,626,110 A | * | 5/1997 | Regueiro | 123/90.22 |

FOREIGN PATENT DOCUMENTS

| | | |
|---|---|---|
| DE | 36 07 170 A | 9/1987 |
| EP | 0 032 284 A | 7/1981 |
| FR | 2 209 396 A | 6/1974 |
| GB | 805729 | 12/1958 |
| JP | 08061020 A | 3/1996 |
| WO | 90/10787 | 9/1990 |

* cited by examiner

*Primary Examiner*—Thomas Denion
*Assistant Examiner*—Ching Chang
(74) *Attorney, Agent, or Firm*—Venable LLP; Catherine M. Voorhees

(57) ABSTRACT

The invention relates to a mechanical valve play compensation element for a valve drive on a piston combustion engine, comprising a first pressure part (1) which is axially displaceable in relation to a second pressure part (2) and which is fixed in such a way that it can turn about the axis of displacement; a torsion spring element (10) which acts between the first pressure part (1) and the second pressure part (2) and is axially flexible at least to a certain extent; and at least one helical surface (9.1) on the first pressure part (1), to which a corresponding helical surface (9.2) on the second pressure part (2) is allocated, these forming a pair of helical surfaces (9). The surfaces of the helical surface pair (9) are configured as a rough surface and are pressed against each other by the torsion spring element (10).

13 Claims, 4 Drawing Sheets

Figure 1:
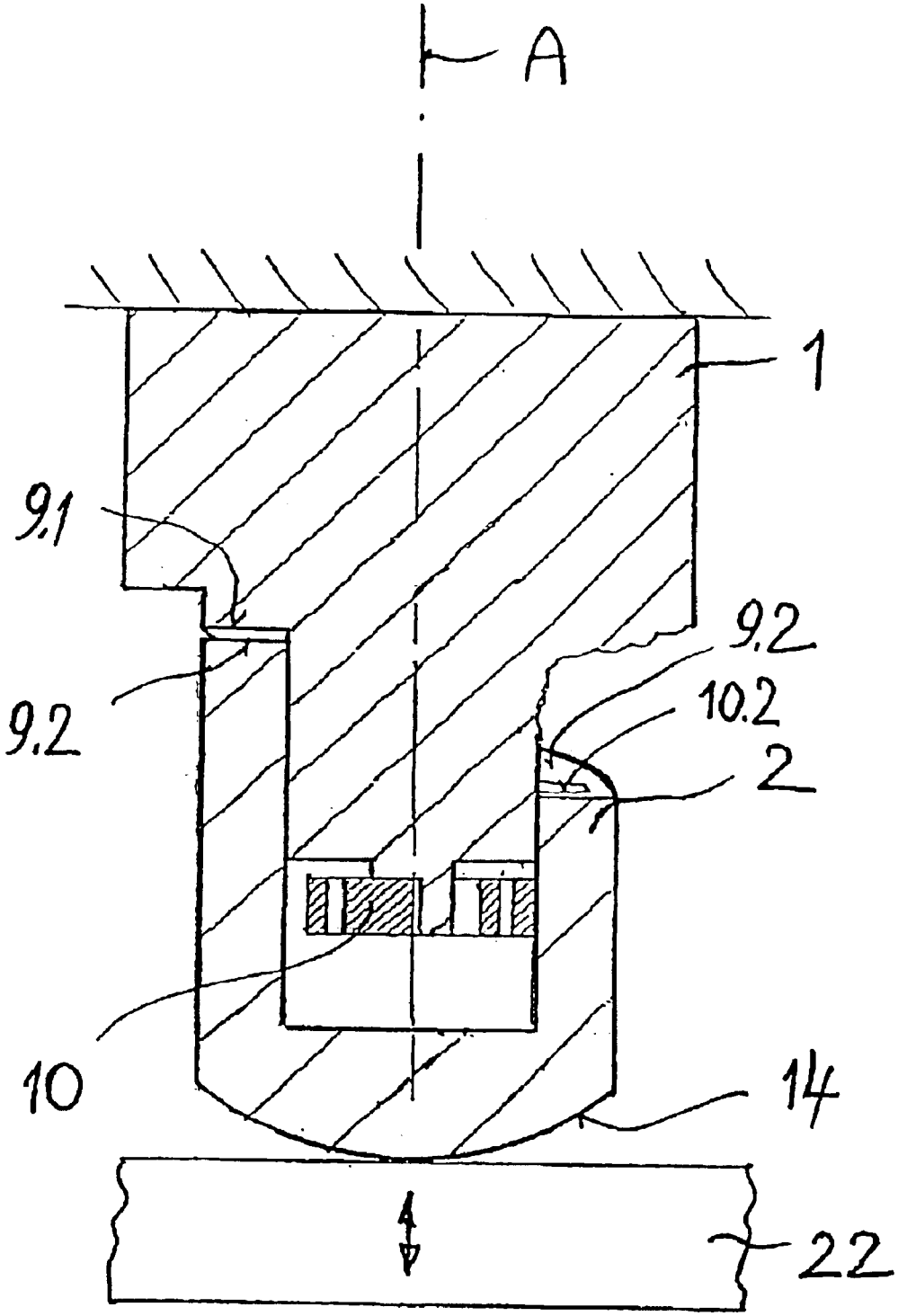

MECHANICAL VALVE PLAY COMPENSATION ELEMENT FOR A VALVE DRIVE ON A PISTON COMBUSTION ENGINE

This application is a 371 of PCT/EP01/12157 filed Oct. 22, 2001

SPECIFICATION

The invention relates to a method for determining the reducing agent concentration ($NH_3$) in the exhaust-gas flow of an internal combustion engine.

In piston combustion engines, it is necessary, between the shaft end of the gas exchange valve on the one hand and the valve drive (cam of the camshaft, valve actuating lever, or the like) acting on it on the other, to dispose a valve play compensation element in order to compensate for temperature-caused changes in the length of the valve shaft and changes, caused by wear to the valve seat, in the height of the shaft end when the gas exchange valve is closed, relative to the valve drive. To that end, a hydraulic valve play compensation element is used, which essentially comprises a cup-shaped cylinder and a piston guided in it; the cylinder interior can be subjected to pressurized oil, so that the two parts can be spread apart and can each come into contact without play on the shaft end of the valve on the one hand and the valve drive on the other. Via a throttle restriction, which is for instance provided by means of a defined gap between the cylinder wall and the piston, it is also possible during operation to compensate for a change in the height of the shaft end relative to the valve drive, whether it is caused by thermal expansion or wear to the valve seat, since via the outflow of oil through the throttle restriction, the total length of the valve play compensation element can be shortened. Such hydraulic valve play compensation elements have proven themselves over time and today are used in practically all piston combustion engines.

The disadvantage of the hydraulic valve play compensation element, however, is that an oil supply must be provided especially for it, which necessitates considerable engineering and production effort and expense at the cylinder head.

A further disadvantage is that any change in the viscosity of the oil used definitively affects the function of such a hydraulic valve play compensation, so that it is practically impossible to design one optimal cam shape for all operating states. Another disadvantage is the high oil consumption, with the result that the oil pump must be designed even for critical operating states, such as idling while hot, and hence is designed to be oversized for normal operation.

Mechanical play compensating elements are also known from European Patent Disclosure EP-A 0 032 284, German Patent Disclosure DE-A 36 07 170, and International Patent Disclosure WO 90/10787.

The object of the invention is to overcome the disadvantages described by means of a mechanical valve play compensation element of simple design and high functional capability.

This object is attained in accordance with the invention by a mechanical valve play compensation element for a valve drive on a piston combustion engine, having a first pressure part, which is axially displaceable relative to a second pressure part and is held rotatably about the displacement axis, and having a torsion spring element, operative between the first pressure part and the second pressure part, that is axially resilient at least to a limited extent, and further having at least one helical surface on the first pressure part, with which surface a corresponding helical surface on the second pressure part is associated, the two forming a pair of helical surfaces, wherein the surfaces of the pair of helical surfaces being embodied as rough surfaces and being pressed against one another by the torsion spring element.

The advantage of this mechanical valve play compensation element is that in the state of repose, which is equivalent to the closing position of the gas exchange valve, as a result of the action of the torsion spring element, the two pressure parts are pressed apart to overcome any play, but contact one another with their helical surfaces. The valve drive can be formed directly by the cam of a camshaft, or via valve actuating levers (tilting levers, drag levers or the like). This assures that given the little force exerted between the two pressure parts during the closing time of the valve, any play that may be present is compensated for.

In the ensuing opening stroke, with the greater exertion of force for opening, the rough surface prevents the two pressure parts from rotating against one another, and thus prevents the compensation element from becoming shortened by being screwed together.

In one embodiment of the invention, the rough surface is embodied as a positive-engagement face, for instance in the form of a stair step profile with inclined step surfaces, so that only a compensation of an increasing valve play is possible, since the step edges each prevent reverse rotation of the pressure parts relative to one another in the direction of shortening the compensation element. The "step height" is expediently equivalent to an allowed working play.

A refinement contemplates a mechanical valve play compensation element in which a slide sleeve surrounding the first pressure part is provided, and a bracing spring element operative between the second pressure part and the slide sleeve is disposed, and furthermore on the first pressure part, a further parallel helical surface and a corresponding helical surface, offset in height from one another, are disposed on the slide sleeve and likewise form a pair of helical surfaces, the surfaces of the one pair of helical surfaces being embodied slidably and being pressed against one another by the torsion spring element, and at least one surface of the other pair of helical surfaces is embodied as a rough surface, whose surfaces are at a slight spacing from one another forming a working play and are each brought into contact with one another only during the valve opening event.

To initiate the valve opening, the elements contacting one another via the pair of helical surfaces, which as a rule are the first pressure part and the slide sleeve, are displaced in the direction of the second pressure part, counter to the exertion of force of the bracing spring, so that after a spacing forming a working play is bridged, the helical surfaces of the pair provided with rough surfaces come into contact with one another. The surface roughness of the two rough surfaces, upon touching one another, brings about a positive engagement, so that the two pressure parts, despite the actuation force acting in the opening direction, counter to the closing force of the valve spring, form an intrinsically rigid body, since rotation of the two pressure parts by becoming screwed into one another is not possible.

As soon as the closing position is regained, after the conclusion of the full valve stroke, the two pressure parts are pressed apart via the bracing spring, and via the exertion of force of the bracing spring between the two surfaces of the slidably embodied pair of helical surfaces, the two pressure parts are pressed apart, and by means of a relative rotation to one another, any valve play that may be present and is greater than the predetermined working play is compensated for. The slope of the pairs of helical surfaces extending parallel to one another is chosen such that no self-locking can occur in the pair of helical surfaces embodied slidably.

In an expedient feature of the invention, it is provided that the exertion of force of the bracing spring to the torsion spring element via the slide faces is markedly greater than the restoring force of the torsion spring element. This assures that changes in the valve play in both the positive and the negative direction, that is, spreading or contraction, caused by alternating operating states, for instance thermally, are assured as long as the rough surfaces do not touch another. As a result, even if the valve plays are changing, a greater play up to the predetermined, slight working play, will always be reliably compensated for. The depth of the roughness of the rough surface must be less than the allowed working play.

It is expedient if in a feature of the invention, ventilation bores are provided for the chambers that are surrounded by the pressure parts and/or by one pressure part and the slide sleeve. On the one hand, this prevents air cushions and/or accumulations of oil from being able to build up in these chambers, and on the other, this assures that by way of ventilation, however slight, oil mists can penetrate these chambers, thus lubricating the surfaces, moving relative to one another, of the individual parts.

Further characteristics and advantages of the invention can be learned from the description of the exemplary embodiments and the claims.

Figure 2:
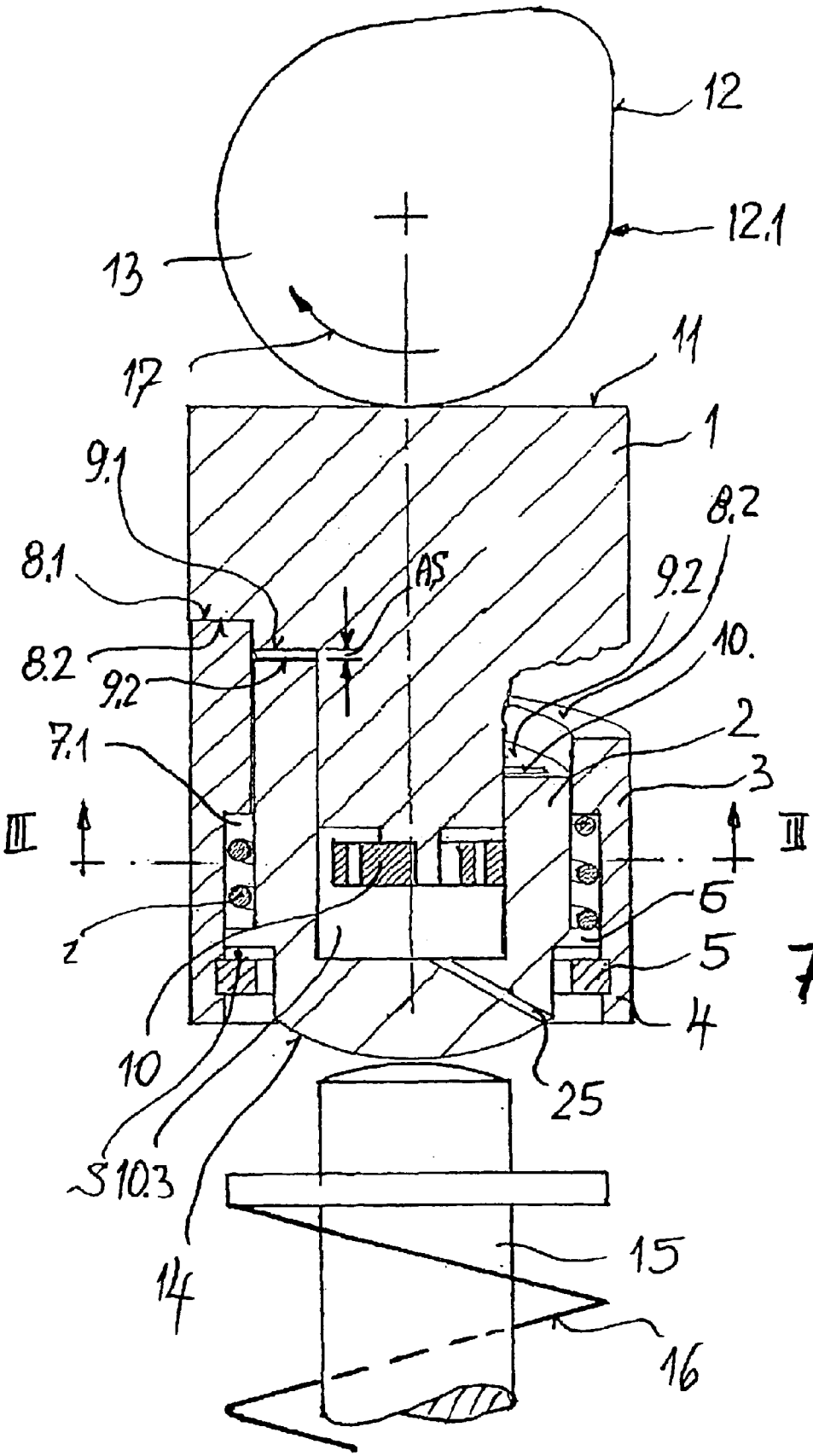
Figure 3:
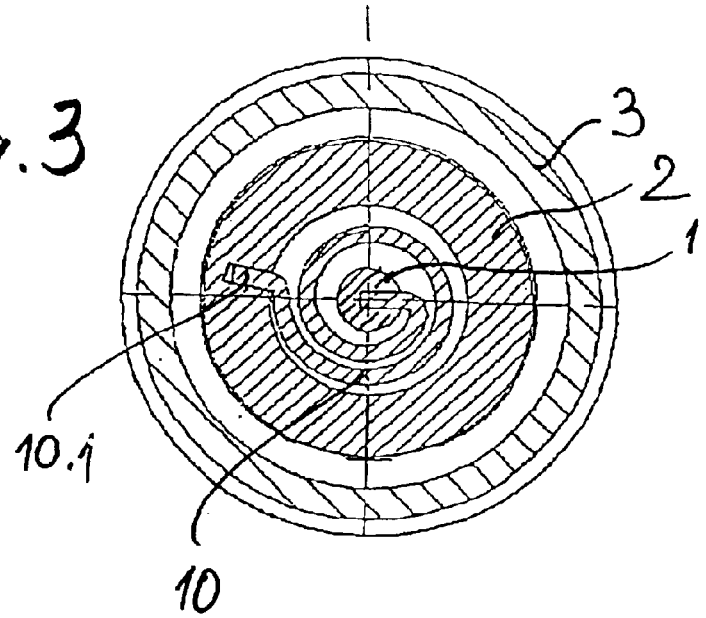
Figure 4:
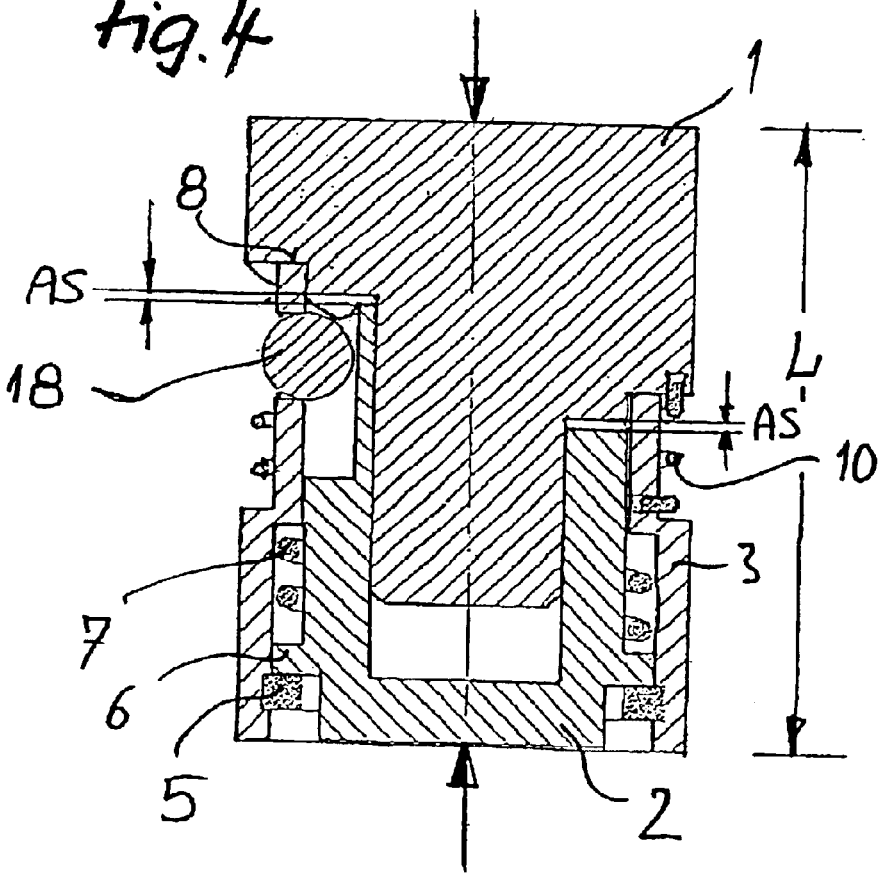
Figure 5:
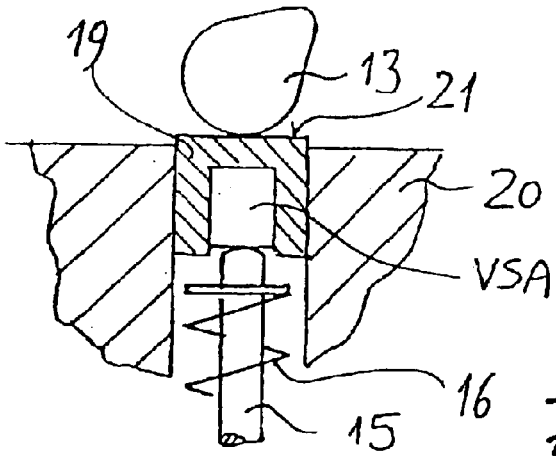
Figure 6:
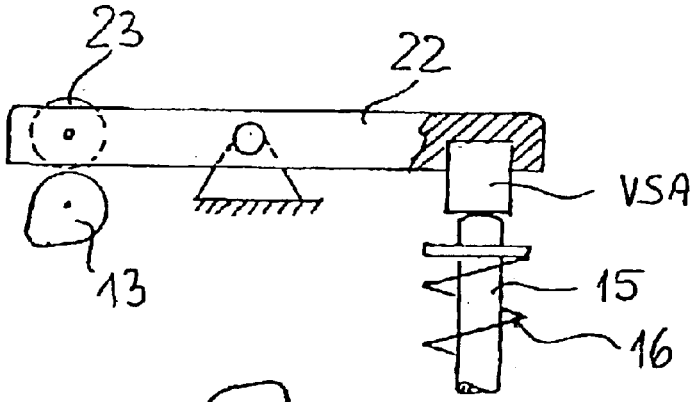
Figure 7:
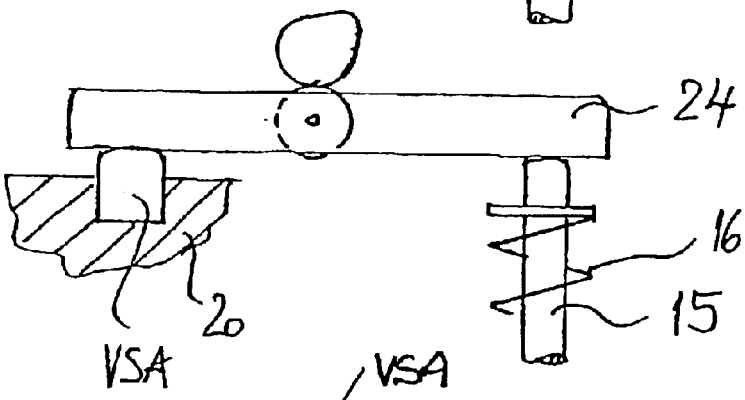
Figure 8:
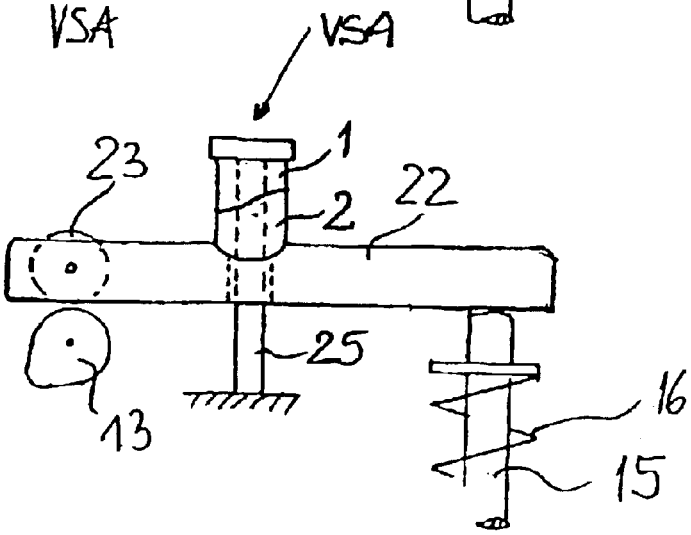

The invention will be described in further detail in terms of schematic drawings of exemplary embodiments. Shown are:

FIG. 1, a first exemplary embodiment of a mechanical valve play compensation element in vertical section;

FIG. 2, a refinement of the valve play compensation element of FIG. 1 in vertical section;

FIG. 3, a section taken along the line III—III in FIG. 2;

FIG. 4, an embodiment modified compared to FIG. 1, in vertical section;

FIG. 5, an example of installation of a valve drive formed by a cam;

FIG. 6, an example of installation for a valve drive embodied as a tilting lever;

FIG. 7, an example of installation for a valve drive embodied as a drag lever;

FIG. 8, an example of installation with a support armature.

The schematic illustration of an exemplary embodiment of a mechanical valve play compensation element in FIG. 1 shows a first pressure part 1, embodied for instance in the form of a die or piston, which is axially displaceable relative to a second pressure part 2 and is retained rotatably about the displacement axis A and is embodied as cup-shaped or cylindrical, for instance. The pressure part 2 is braced by its free end 14, for instance on a drag lever 22 to be actuated. The first pressure part 1 is kept stationary, or is connected to a valve drive, depending on the intended use.

The first pressure part 1 is provided, on its side oriented toward the second pressure part 2, with a helical surface 9.1, with which a corresponding helical surface 9.2 on the second pressure part 2 is associated. The associated helical surfaces form a pair 9 of helical surfaces. Of the helical surfaces 9.1 and 9.2 of the pair 9 of helical surfaces, at least one helical surface is embodied as a rough surface, and the coefficient of friction of this rough surface should amount to at least 0.4 $\mu$m.

The term "rough surface" includes any surface structure that prevents the surfaces from sliding freely on one another. This can be accomplished by roughening them or shaping them in a targeted way, for instance via a tooth profile, wavelike profile or stepped profile with descending step faces that are oriented at an angle to the helical surface. The profile depth or "roughness depth" amounts to up to several tenths of a millimeter on both helical surfaces 9.1 and 9.2, forming positive-engagement faces that upon engagement reliably prevent rotation of the two pressure parts.

Since the helical surfaces 9.1 and 9.2 are in contact with one another over a considerable length, the pressure per unit of surface area operative between them can be reduced markedly, minimizing wear. It is also sufficient if the length of the helical surface is approximately equal to the circumference of the pressure part; the slope must be selected such that with certainty, no self-locking ensues except for locking by way of the roughness.

The cutaway right-hand side of the first pressure part 1 allows the course of the helical surface 9.2 on the second pressure part 2 to be seen.

Between the first pressure part 1 and the second pressure part 2, a torsion spring element 10 is provided, which is shown here as a spiral spring and which between the two pressure parts brings about a restoring force that is capable of rotating the two pressure parts, if a play exists that is greater than the predetermined roughness depth.

The torsion spring element 10 is embodied here such that on being screwed into one another in the axial direction, it is either held axially displaceably in its anchor, or is resilient in the axial direction, for instance if a round cross section is chosen for the spiral instead of a rectangular cross section.

The end face 11 of the first pressure part 1 rests on a fixed anchor, or as shown in FIG. 2, on the control contour 12 of a control cam 13. The end face 14, for instance curved forward convexly, of the second pressure part 2 rests on the free end of the valve shaft 15 of a gas exchange valve or actuating element 22.

The schematic illustration in FIG. 2 shows a further exemplary embodiment for a mechanical valve play compensation element, which has been developed from the embodiment of FIG. 1. Here the second pressure part 2 is surrounded on its outside by a slide sleeve 3, which is provided on its free end 4 with an end stop 5 with which a collar-like extension 6 on the second pressure part 2 is associated.

In a free chamber 7.1 between the slide sleeve 3 and the second pressure part 2, a bracing spring element 7, for instance in the form of a helical compression spring, is provided, by which the second pressure part 2 is pressed by its extension 6 against the end stop 5.

The first pressure part 1, on its side toward the second pressure part 2 and the slide sleeve 3, is provided with two parallel-extending helical surfaces 8.1 and 9.1, offset from one another in height, with each of which a corresponding helical surface 8.2 on the slide sleeve 3 and a helical surface 9.2 on the second pressure part 2 are associated. The associated helical surfaces each form one pair 8 and 9 of helical surfaces. The helical surfaces 8.1 and 8.2 of the pair 8 of helical surfaces are smooth and thus embodied slidably; the coefficient of friction should expediently not exceed 0.2 $\mu$m. Of the helical surfaces 9.1 and 9.2 of the pair of helical surfaces, at least one helical surface is embodied as a rough surface.

The cutaway right-hand side of the first pressure part 1 makes the course of the helical surface 8.2 on the slide sleeve 3 and of the helical surface 9.2 on the second pressure part 2 visible.

The torsion spring element 10 is disposed between the first pressure part 1 and the second pressure part 2 and between the two pressure parts effects the restoring force that rotates the two pressure parts slidingly on the pair 8 of helical surfaces.

As FIG. 2 shows, via the bracing spring 7, the slide sleeve 3 is pressed together with the first pressure part 1 against the control contour 12 of the cam 13. As a reaction force, correspondingly the second pressure part 2 is pressed with its end face 14 against the end of the valve shaft 15. This assures that the valve play compensation element will be held without play between the cam 13 on one side and the valve shaft 15 on the other. The lateral fixation depends on the particular installation situation, for which exemplary embodiments are provided below.

The torsion spring 10 that connects the first and second pressure parts to one another is oriented in terms of its exertion of force such that the torsion spring 10 seeks to screw the two pressure parts into one another, thus assuring a tight contact of the pair 8 of helical surfaces. The two pairs 8 and 9 of helical surfaces are disposed at staggered heights from one another, by an amount of a few μm, so that there is a working play AS.

In a direction of rotation of the cam 13 in the direction of the arrow 16, with the onset 12.1 of the raised area, beginning as a result of the control contour 12, above the base circle, the first pressure part 1 is moved downward together with the slide sleeve 3 counter to the force of the bracing spring 7. Although the two helical surfaces 8.1 and 8.2 are embodied as smooth, and thus a rotation of the first pressure part 1 relative to the second pressure part 2 is possible, nevertheless the movement is so quick that because of inertia and the effects of friction, no or only slight rotation of the two parts relative to one another takes place, and once the working play AS is overcome in the pair 9 of helical surfaces, the helical surface 9.1 takes a seat on the helical surface 9.2. Since at least one surface of the pair 9 of helical surfaces is embodied as a rough surface, the friction is so great that despite the high axial forces in the opening event, rotation of the first pressure part 1 relative to the second pressure part 2 is prevented, and thus the entire arrangement acts as a rigid body and is capable of transmitting the opening stroke, predetermined by the control contour 12 of the cam 13, to the valve shaft 15.

In the ensuing closing stroke, the entire motion is in the opposite direction, so that immediately after the valve has become seated on its valve seat, is kept in contact via the bracing spring 7 with the base circle on the control contour 12.

By means of a correspondingly predetermined play S between the extension 6 on the second pressure part 2 and the end stop 5 on the slide sleeve 3, play-free contact of the entire arrangement between the control contour of the cam 13 and the valve shaft 15 is assured.

If because of operating conditions, the spacing between the base circle of the cam 13 and the free end of the valve shaft 15 increases, then this increase in spacing is initially compensated for via the compensation for the play S between the extension 6 and the end stop 5 via the bracing spring 7.

If this play S is then exceeded, then the helical surface 8.2 is pressed against the helical surface 8.1 by the bracing spring 7 via the slide sleeve 3, so that by this exertion of force, the first pressure part 1 is screwed outward compared to the second pressure part 2, counter to the force of the torsion spring 10. This is possible because the two helical surfaces 8 are embodied with smooth surfaces and thus are slidable, and the "thread" formed by the contacting helical surfaces is dimensioned such that no self-locking occurs.

Since the two pairs 8 and 9 of helical surfaces are disposed extending parallel to one another, the working play AS remains, at a constant magnitude.

The design of the individual springs is intended such that the exertion of force of the bracing spring 7 via the slide faces 8 on the torsion spring element 10 is dimensioned as markedly greater than the restoring force of the torsion spring element 10. On the other hand, the force of the bracing spring 7 must be markedly less than the closing force of the valve spring 16.

In FIG. 3, a horizontal section is shown through the embodiment of FIG. 3, taken along the line III—III in FIG. 1. In the exemplary embodiment shown here, the spiral spring 10 is made of band material and is held with its outer free end 10.1 in a corresponding groove 10.2 in the second pressure part 2, so that the longitudinal mobility predetermined by the working play AS is assured. Instead of a band material, it may be expedient to use a round material, so that the torsion spring 10, embodied as a spiral spring, can be fastened firmly by both ends, since an adequate deformation in the axial direction is assured by the round material. The horizontal section applies accordingly to the version of FIG. 1.

In the embodiment of FIG. 1 or FIG. 2, the chamber 10.3 surrounding the torsion spring element 10 is ventilated via the groove 10.2 that is open to the outside. Via a corresponding groove, not shown in detail here, the chamber 7.1 surrounding the bracing spring 7 is also ventilated, so that in these chambers, no air cushions can build up during the motion.

In this respect, instead of ventilation via the groove 10.1, it may be expedient to provide a separate bore 25, so that not only is ventilation assured, but it is also assured that no oil supply can accumulate in the chamber 10.3 of the second pressure part 2. Correspondingly, the chamber 7.1 should also be ventilated, to avoid an accumulation of oil.

In FIG. 4, a modification of the embodiment of FIG. 1 and FIG. 2 is shown, which essentially differs from the embodiment of FIG. 1 only in that the torsion spring 10 is embodied as a leg spring and is supported on the outside of the slide sleeve 3 and is fixed by one end to the first pressure part 1, while its other end is fixed to the slide sleeve 3. The rotary motion for bridging the working gap AS is thus effected between the slide sleeve 3 and the pressure part 1. Accordingly, a means 18 of securing against relative rotation, shown only schematically here, must be disposed between the second pressure part 2 and the slide sleeve 3, but it must allow an axial motion between the two parts. In this system, once again the "unscrewing" of the pressure part 1 and pressure part 2 is again assured via the bracing spring 7; on the other hand, by the torsion spring element 10, a play-free contact of the pair 8 of helical surfaces is possible, and upon an exertion of force corresponding to the two arrows P, the contraction of the first pressure part 1 into the second pressure part 2 is possible by the amount of the working play AS, and the rough surfaces of the pair 9 of helical surfaces come into contact with one another, so that the opening and closing strokes can then ensue without any further change in the total length L of the entire arrangement.

In the following drawings, examples of installation for the valve play compensation elements described in conjunction with FIGS. 1, 2 and 3 will be shown.

In the arrangement of FIG. 5, the valve play compensation element VSA is retained in a bearing body 19, which is guided displaceably in the cylinder head 20. The bearing body 19 is associated directly with the end of the valve shaft 15 and its valve spring 16, so that the cam 13, with its control contour 12, can act directly on the end face 21 of the bearing body 19.

In FIG. 6, the disposition of the valve play compensation element VSA of the invention in a tilting lever 22 is shown; by one end, this lever is in contact with the valve shaft 15 via the valve play compensation element VSA, and by its other end, it is in contact with the cam 13 of the camshaft via a roller 23.

FIG. 7 schematically shows the disposition on a drag lever 24, which is braced by one end directly on the valve shaft 15 and by its other end on a valve play compensation element VSA supported in the cylinder head 20. Once again, the drag lever 24 rests on the control contour 12 of the cam 13, via a roller 23.

The control contour 12 of the cam 13 can be embodied such that it is provided with a preliminary cam at the beginning 12.1 of the opening stroke, which assures that the working play AS will rapidly be overcome.

FIG. 8 shows a modification of the arrangement of FIG. 6, with a valve play compensation element of FIG. 1. Here the tilting lever 22 is supported tiltably on the valve play compensation element VSA, which in turn is braced on the engine block via a support armature 25. The motion is initiated via the cam 13 or a tappet.

What is claimed is:

1. A mechanical valve play compensation element for a valve drive on a piston combustion engine, having a first pressure part (1), which is axially displaceable relative to a second pressure part (2) and is held rotatably about the displacement axis, and having a torsion spring element (10), operative between the first pressure part (1) and the second pressure part (2), that is axially resilient at least to a limited extent, and further having at least one helical surface (9.1) on the first pressure part (1), with which surface a corresponding helical surface (9.2) on the second pressure part (2) is associated, the two forming a pair (9) of helical surfaces, wherein the surfaces of the pair (9) of helical surfaces are embodied as rough surfaces and are pressed against one another by the torsion spring element (10), a slide sleeve (3) surrounds the first pressure part (1), a chamber (7.1, 10.3) is surrounded by the pressure parts (1.2), and at least one ventilation bore is provided for the chamber.

2. The element of claim 1, characterized in that the rough surfaces of the pair (9) of helical surfaces are embodied by purposeful shaping as positive-engagement faces.

3. A mechanical valve play compensation element for a valve drive on a piston combustion engine, having a first pressure part (1), which is axially displaceable relative to a second pressure part (2) and is held rotatably about the displacement axis, and having a torsion spring element (10), operative between the first pressure part (1) and the second pressure part (2), that is axially resilient at least to a limited extent, and further having at least one helical surface (9.1) on the first pressure part (1), with which surface a corresponding helical surface (9.2) on the second pressure part (2) is associated, the two forming a pair (9) of helical surfaces, wherein the surfaces of the pair (9) of helical surfaces are embodied as rough surfaces and are pressed against one another by the torsion spring element (10), characterized in that a slide sleeve (3) surrounding the first pressure part (1) is provided, and a bracing spring element (7) operative between the second pressure part (2) and the slide sleeve (3) is disposed, and furthermore on the first pressure part (1), a further parallel surface (8.1) and a corresponding helical surface (8.2), offset in height from one another, are disposed on the slide sleeve (3) and likewise form a pair (8) of helical surfaces, the surfaces of the one pair (8) of helical surfaces being embodied slidably and being pressed against one another by the torsion spring element (10), and at least one surface of the other pair (9) of helical surfaces is embodied as a rough surface, whose surfaces are at a slight spacing from one another forming a working play (AS) and are each brought into contact with one another only during the valve opening event.

4. The element of claim 3, characterized in that at least one arrangement of stops (5, 6) that limits the bracing travel is disposed between the slide sleeve (3) and the first pressure part (1).

5. The element of claim 1, characterized in that the outward-pointing face-end pressure faces (11, 14) of at least one of the two pressure parts (1, 2) are embodied as curved convexly forward or concavely inward.

6. The element of claim 3, characterized in that ventilation bores (10.1, 25) are provided for the chambers (7.1, 10.3) that are surrounded by the pressure parts (1, 2) and/or by one pressure part (1, 2) and the slide sleeve (3).

7. The element of claim 3, characterized in that the exertion of force of the bracing spring (7) to the torsion spring element (10) via the slidable pair (8) of helical surfaces is markedly greater than the restoring force of the torsion spring element (10).

8. The element of claim 1, characterized by the disposition in a bearing body, which is guided displaceably in the cylinder head (20) and is acted upon by the associated cam (13) of the camshaft.

9. The element of claim 1, characterized in that a pressure part (1, 2) is solidly connected to the shaft end (15) of a gas exchange valve.

10. The element of claim 1, characterized by the disposition in a recess of a valve actuating lever (22, 24).

11. The element of claim 1, characterized by the disposition in a recess in the cylinder head (20) for bracing a lever (24) of a valve drive.

12. The element of claim 1, characterized in that by the bracing of the first pressure part (1) by a stationary anchor (25) and the bracing of the second pressure part (2) on a valve actuating lever (22) effected, which acts by one end on the valve and by its other end is connected to the valve drive (13).

13. The element of claim 1, characterized in that a plurality of the chambers (7.1, 10.3) are surrounded by the pressure parts (1,2) and/or by one pressure part (1,2) and the slide sleeve (3), and that ventilation bores (10.1, 25) are provided for the chambers.

* * * * *